US011739557B2

(12) United States Patent
Shen

(10) Patent No.: US 11,739,557 B2
(45) Date of Patent: Aug. 29, 2023

(54) EASILY EXTENDABLE AND RETRACTABLE CANOPY MECHANISM

(71) Applicant: Ningbo Xinyuan Leisure Products Co. Ltd., NingBo (CN)

(72) Inventor: Zilv Shen, Ningbo (CN)

( * ) Notice: Subject to any disclaimer, the term of this patent is extended or adjusted under 35 U.S.C. 154(b) by 0 days.

(21) Appl. No.: 17/485,778

(22) Filed: Sep. 27, 2021

(65) Prior Publication Data

US 2023/0099670 A1 Mar. 30, 2023

(51) Int. Cl.
*E04H 15/48* (2006.01)

(52) U.S. Cl.
CPC ..... *E04H 15/48* (2013.01)

(58) Field of Classification Search
CPC ..... E04H 15/50
USPC ..... 135/135, 146, 147, 1, 159
See application file for complete search history.

(56) References Cited

U.S. PATENT DOCUMENTS

| | | | | |
|---|---|---|---|---|
| 7,628,165 | B2 * | 12/2009 | Rothweil | E04H 15/48 135/147 |
| 8,418,711 | B2 * | 4/2013 | Park | E04H 15/50 135/145 |
| 10,280,645 | B1 * | 5/2019 | Yang | E04H 15/50 |
| 10,597,897 | B2 * | 3/2020 | Yang | E04H 15/46 |
| 10,844,593 | B1 * | 11/2020 | Matsuoka | E04H 15/50 |
| 11,072,943 | B2 * | 7/2021 | Sun | E04H 15/32 |
| 11,225,809 | B2 * | 1/2022 | Choi | E04H 15/50 |
| 11,299,906 | B2 * | 4/2022 | Yang | E04H 15/60 |
| 2018/0298631 | A1 * | 10/2018 | Yang | E04H 15/50 |
| 2020/0157838 | A1 * | 5/2020 | Yuan | E04H 15/50 |
| 2022/0228397 | A1 * | 7/2022 | Yang | E04H 15/54 |
| 2022/0268052 | A1 * | 8/2022 | Sun | E04H 15/50 |

* cited by examiner

*Primary Examiner* — David R Dunn
*Assistant Examiner* — Danielle Jackson
(74) *Attorney, Agent, or Firm* — Sandy Lipkin

(57) ABSTRACT

The present invention relates to the technical field of outdoor equipment, in particular to an easily extendable and retractable canopy mechanism comprising two center hubs arranged up and down and several carrier rods. The first and second center hubs are arranged on the same vertical line. One end of the carrier rods is rotatably connected to the first center hub with equal angle between any two adjacent carrier rods. It also comprises equal number of support rods and carrier rods. One end of the support rods is rotatably connected to the second center hub and the other end is fixed on the side of the carrier rods. The angle between any two adjacent support rods is equal. The carrier rods have stop blocks at the upper part of the fixed connection between the carrier rods and the support rods. The present invention improves the existing tent roofs and removes the self-locking structure commonly used in the prior art to achieve the current effect with more convenience and less effort based on simpler mechanism, which is applicable to tents and other outdoor equipment.

6 Claims, 2 Drawing Sheets

EASILY EXTENDABLE AND RETRACTABLE CANOPY MECHANISM

FIELD OF THE INVENTION

The present invention relates to the technical field of outdoor equipment, in particular to an easily extendable and retractable canopy mechanism.

BACKGROUND OF THE INVENTION

Tents can serve as a temporary sunshade and rain shelter for people who go out for travel, picnic or other outdoor works, so they have a wide range of applications. Pop-up tents are easily opened and set up to form a large area of sheltering space, or quickly folded into small members that are easy to carry and store, which can be used at outdoor exhibitions, product promotions, celebration parties, sales, tourism, recreation, field work, and food stalls. They are easy to install and operate, and can be used in temporary activities such as song and dance parties, and serve as long-term leisure facilities in parks, tourist resorts and scenic spots.

The existing tent roofs are provided with complicated self-locking structure and not easy to operate, which are prone to clamp hands causing accidental injury to users with poor experience during use.

SUMMARY OF THE INVENTION

In order to solve the above technical problems, the present invention discloses an easily extendable and retractable canopy mechanism and its applications. The technical scheme is as follows:

An easily extendable and retractable canopy mechanism comprises two center hubs arranged up and down and several carrier rods. The center hubs are set up as the first center hub and the second center hub which are arranged on the same vertical line. One end of the carrier rods is rotatably connected to the first center hub and the angle between any two adjacent carrier rods is equal. It also comprises support rods with the same number as that of the carrier rods. One end of the support rods is rotatably connected to the second center hub and the other end is fixed on the side of the carrier rods. The angle between any two adjacent support rods is equal. The carrier rods are provided with stop blocks which are arranged at the upper part of the fixed connection between the carrier rods and the support rods. The number of the carrier rods and the support rods is greater than or equal to three. Preferably, the number of the carrier rods and the support rods is four.

The above technical scheme shows that the easily extendable and retractable canopy mechanism mainly applies to pop-up tents, also suitable for other outdoor equipment such as flower stands. In addition, multiple carrier rods can be arranged according to the shapes of tents or flower stands, e.g. three carrier rods with an angle of 120° form a triangle tent, four carrier rods with an angle of 90° form a rectangle tent, and five carrier rods with an angle of 72° form a pentagon tent. Only one person is required to extend the skeleton of a pop-up tent supposing it is a simple triangle or rectangle tent: drag the column of the skeleton to move outward until the skeleton is extended to a certain extent. Enter the skeleton and hold up the support rods. It is best to hold up the second center hub to save effort. The support frame formed by the second center hub and the support rods will automatically spring up according to the "dead point" principle when it is higher than the plane parallel to the ground. The upper stop block of the carrier rod restricts and fixes the support frame to support the entire tent skeleton. Reversely, to fold up the tent skeleton, pull down the second center hub or the support rods to allow the second center hub to be lower than the plane parallel to the ground. The support frame will automatically retract downward to fold up the tent skeleton.

As a further improvement of the present invention, the carrier rods are connected to the support rods with rivets. The rivet connection achieves more firm connections without protruding parts, which is convenient for tent covering.

As a further improvement of the present invention, the stop block is made of plastics by integral molding and exhibits a rectangular overall structure. Two grooves are arranged on one side of the stop block, one of which is buckled on the carrier rod, and the other of which is used for buckling the support rod.

As a further improvement of the present invention, a pull rod and a handle are arranged. One end of the pull rod is fixed at the center of the second center hub, and the other end is fixed to a handle. The handle is arranged for easily holding up or pulling down the second center hub. In addition, other objects can be hung at the handle for easy use. The second center hub is connected to the handle by the pull rod.

As a further improvement of the present invention, the central parts of the first center hub and the second center hub are hollow with threads on the inner surface. The pull rod is provided with matching threads on the outer surface. The length of the pull rod is greater than the shortest distance between the first center hub and the second center hub. The central parts of the first center hub and the second center hub are provided with threads to facilitate the rise and fall of the pull rod. When the tent is extended, the pull rod can be screwed up to press against the first center hub to further reinforce the entire roof structure.

The beneficial effects of the present invention are: the present invention improves the existing tent roofs and removes the self-locking structure commonly used in the prior art to achieve the current effect with more convenience and less effort based on simple mechanical principles, which is applicable to tents and other outdoor equipment.

Figure 1:
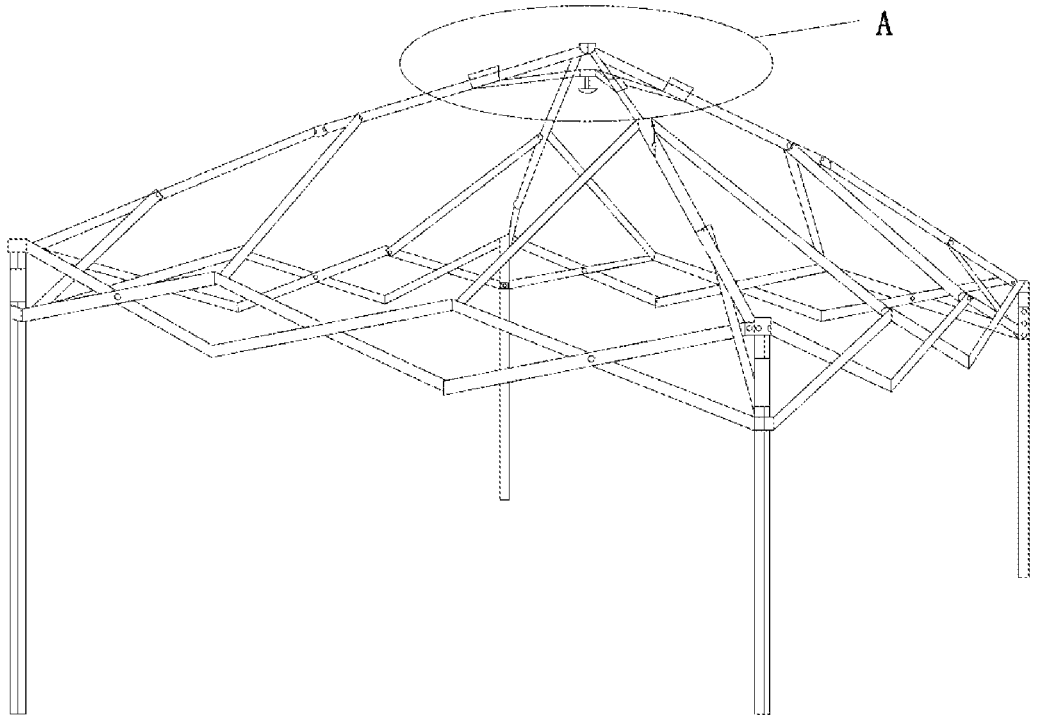
FIG. 1 is a structural schematic diagram of the tent skeleton of the present invention.

Description of the Reference Numerals: 1. The first center hub; 2. The second center hub; 3. Carrier rod; 4. Support rod; 5. Stop block; 6. Rivet; 7. Handle; 8. Pull rod; 9. Limit groove

DETAILED DESCRIPTION OF A PREFERRED EMBODIMENT

For better understanding of the present invention, the present invention will be further described in detail below with reference to the accompanying drawings and an embodiment. It should be understood that the embodiment described herein is only used to illustrate the present invention, but not to limit the protection scope of the present invention.

Figure 2:
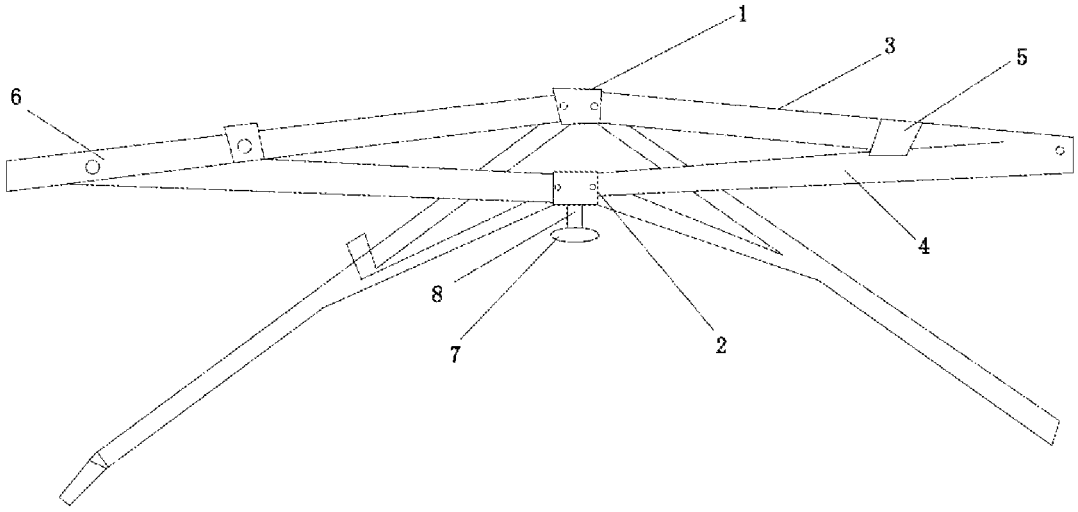
FIG. 2 is an enlarged structural diagram of Part A in FIG. 1.

As shown in FIGS. 1 and 2, a pop-up tent support comprises at least three columns, a canopy frame supported on the columns, and a pop-up frame connected between two adjacent columns. In this embodiment, four columns are arranged and form a square when the tent support is extended. The canopy frame comprises two center hubs arranged up and down and four carrier rods (3). The center hubs are set up as the first center hub (1) and the second center hub (2). The centers of the first center hub (1) and the second center hub (2) lie on the same vertical line. One end of the carrier rods (3) is rotatably connected to the first center hub (1) and the angle between any two adjacent carrier rods (3) is equal. It also comprises four support rods (4). One end of the support rods (4) is rotatably connected to the second center hub (2) and the other end is fixed on the side of the carrier rods (3). The angle between any two adjacent support rods (4) is equal. The carrier rods (3) are provided with stop blocks (5) which are arranged at the upper part of the fixed connection between the carrier rods (3) and the support rods (4). It also comprises a pull rod (8) and a handle (7). One end of the pull rod (8) is fixed at the center of the second center hub (2), and the other end is fixed to the handle (7). The length of the pull rod (8) can be greater than the shortest distance between the first center hub (1) and the second center hub (2). The central parts of the first center hub (1) and the second center hub (2) are provided with threads to facilitate the rise and fall of the pull rod (8). When the tent is extended, the pull rod can be screwed up to press against the first center hub (1) to further reinforce the entire roof structure.

In this embodiment, the carrier rods (3) are connected to the support rods (4) with rivets (6). The rivet (6) connection achieves more firm connections without protruding parts, which is convenient for tent covering.

Figure 3:
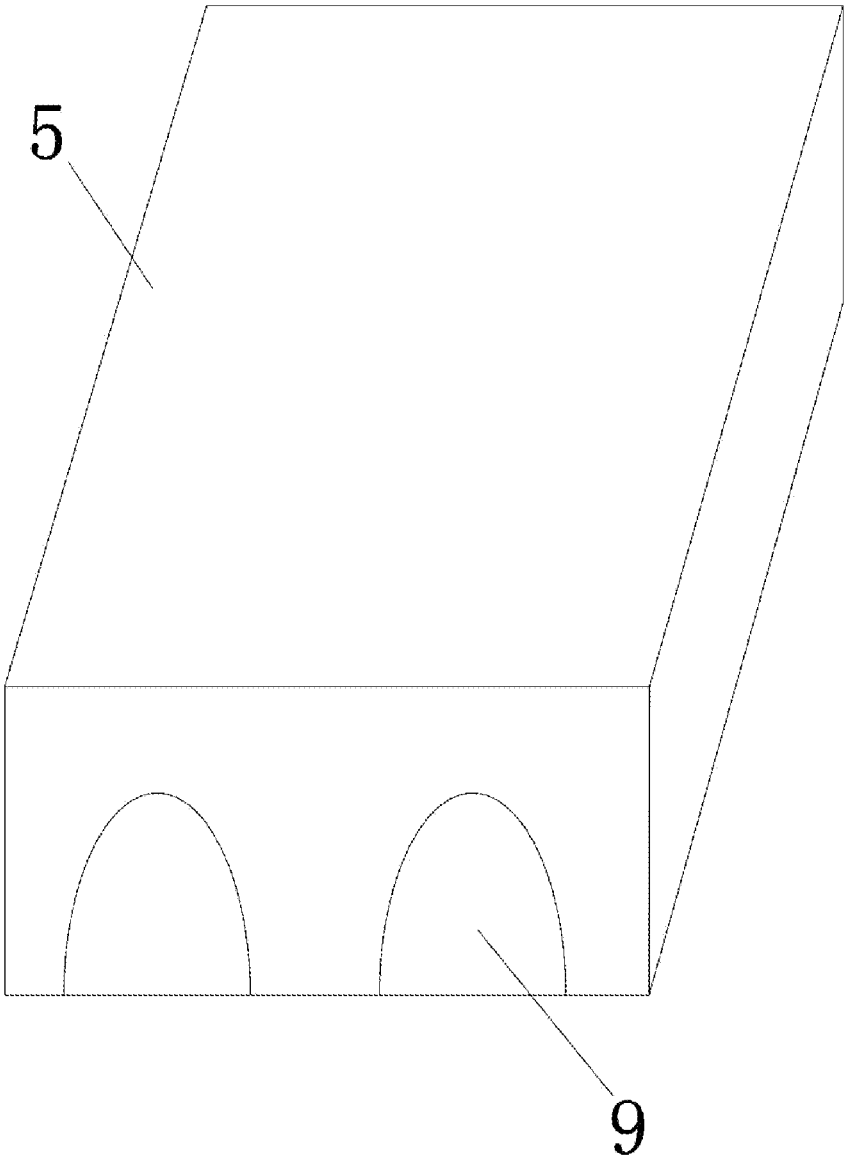
FIG. 3 is a structural schematic diagram of the stop block of the present invention.

As shown in FIG. 3, the stop block (5) is made of plastics by integral molding and exhibits a rectangular overall structure. Two grooves are arranged on one side of the stop block (5). One limit groove (9) is buckled on the carrier rod (3), and the other limit groove (9) is used for buckling the support rod (4).

The working principle of this embodiment is as follows: only one person is required to extend the skeleton of a pop-up tent supposing it is a simple triangle or rectangle tent: drag the column of the skeleton to move outward until the skeleton is extended to a certain extent. Enter the skeleton and hold up the support rods (4). It is best to hold up the second center hub (2) to save effort. The support frame formed by the second center hub (2) and the support rods (4) will automatically spring up according to the "dead point" principle when it is higher than the plane parallel to the ground. The upper stop block (5) of the carrier rod (3) restricts and fixes the support frame to support the entire tent skeleton. Reversely, to fold up the tent skeleton, pull down the second center hub (2) or the support rods (4) to allow the second center hub (2) to be lower than the plane parallel to the ground. The support frame will automatically retract downward to fold up the tent skeleton.

What is claimed is:

1. An easily extendable and retractable canopy mechanism, comprising:

a first center hub and a second center hub arranged up and down, wherein the first center hub and the second center hub are arranged on a common vertical line, wherein the first center hub is above the second center hub on the common vertical line;

a plurality of carrier rods, wherein one end of each of said carrier rods being rotatably connected to said first center hub, wherein an angle between any two adjacent carrier rods is equal;

a plurality of support rods corresponding in equal quantity to each of said carrier rods, wherein one end of each of said support rods is rotatably connected to said second center hub and an opposite end is attached to a side of said carrier rods, wherein an angle between any two adjacent support rods is equal, said carrier rods being provided with stop blocks which are arranged at an upper position on each of said carrier rods, wherein said stop block is made of plastics by an integral molding and exhibits a rectangular overall structure, wherein two grooves are arranged on one side of said stop block, one of which is buckled on said carrier rod and the other of which is used for buckling said support rod.

2. An easily extendable and retractable canopy mechanism according to claim 1, wherein the number of carrier rods and support rods is greater than or equal to three.

3. An easily extendable and retractable canopy mechanism according to claim 2, wherein the number of carrier rods and support rods is four.

4. An easily extendable and retractable canopy mechanism according to claim 3, wherein the carrier rods are connected to the support rods with rivets.

5. An easily extendable and retractable canopy mechanism according to claim 1, further comprising a pull rod and a handle, wherein one end of the pull rod is fixed at a center of the second center hub, and the other end is fixed to the handle.

6. An easily extendable and retractable canopy mechanism according to claim 1, further comprising a pull rod and a handle, wherein a center of the second center hub is hollow with threads on the inner surface of the center, wherein said pull is provided with matching threads on the outer surface of the pull rod, wherein the length of the pull rod is greater than the shortest distance between the first center hub and second center hub.

* * * * *